US005353946A

United States Patent [19]

Behrend

[11] Patent Number: 5,353,946

[45] Date of Patent: Oct. 11, 1994

[54] CONTAINER WITH RECLOSABLE LID LATCH

[75] Inventor: Grace A. Behrend, Englishtown, N.J.

[73] Assignee: Church & Dwight Co., Inc., Princeton, N.J.

[21] Appl. No.: 97,764

[22] Filed: Jul. 26, 1993

[51] Int. Cl.[5] ..... B65D 45/02

[52] U.S. Cl. ..... 220/326; 220/254; 220/339; 220/259; 220/355

[58] Field of Search ..... 220/326, 254, 256, 259, 220/324, 334, 339, 355, 359; 215/216, 225, 237, 239

[56] References Cited

U.S. PATENT DOCUMENTS

| | | | |
|---|---|---|---|
| 4,293,079 | 10/1981 | Lytle | 220/306 |
| 4,344,646 | 8/1982 | Michel | 220/326 X |
| 4,501,378 | 2/1985 | Berfield | 220/324 |
| 4,736,870 | 4/1988 | Christensson | 220/461 |
| 4,746,008 | 5/1988 | Heverly et al. | 220/306 X |
| 4,989,744 | 2/1991 | Tominaga | 220/339 |
| 5,050,763 | 9/1991 | Christensson | 220/355 |
| 5,127,534 | 7/1992 | Fite, Jr. | 220/254 |
| 5,137,260 | 8/1992 | Pehr | 215/216 |
| 5,145,088 | 9/1992 | Goujon | 220/355 |
| 5,219,087 | 6/1993 | Christensson | 220/270 |

*Primary Examiner*—Allan N. Shoap
*Assistant Examiner*—Vanessa Caretto
*Attorney, Agent, or Firm*—Charles B. Barris

[57] ABSTRACT

A container with a reclosable lid is disclosed as including upper and lower frames and a childproof latching device having finger grips operable to release a retainer from a keeper to open the lid wherein the finger grips require a movement to free the retainer and a movement to displace the retainer away from the keeper.

8 Claims, 2 Drawing Sheets

CONTAINER WITH RECLOSABLE LID LATCH

FIELD OF INVENTION

The present invention relates to a container having a reclosable lid and, more particularly, to such a container lid provided with a childproof latch.

BACKGROUND OF THE INVENTION

The prior art is exemplified by U.S. Pat. No. 4,736,870 and No. 5,050,763, both of which are incorporated herein by reference. U.S. Pat. No. 5,050,763 shows a container having a reclosable lid hinged to a frame that is secured to the upper edge of a container U.S. Pat. No. 4,736,870 shows a similar type container with a reclosable lid hinged to its frame. While each of these two patents has tab devices for opening and closing its lid relative to its frame, neither has any means whatsoever to childproof the reclosable feature of the container.

An additional patent, U.S. Pat. No. 4,746,008, shows a child-resistant box for medicines and other harmful products. The box utilizes four spaced latches with two on a front side and one each on adjacent sides. However, this patent requires two adult hands to span the distance between the latches and simultaneously actuate all the latches in order to open the box. The present invention requires the use of only two fingers to open its box.

OBJECTIVES OF THE INVENTION

It is an object of the present invention to provide a container with an attached lid having a childproof operation between the lid and the container.

The present invention has another object in that the movable position of a latch is carried by a cover frame of a reclosable box lid for cooperation with a fixed keeper carried by a fixed frame.

Another object of the present invention is to construct the movable portions of a box latch in a T shape configuration, one leg of which has a retainer block to prevent movement thereof relative to a keeper on the fixed portion of the box latch.

It is a further object of the present invention to construct a box lid with a fixed portion and a movable portion and to provide a childproof arrangement between the two portions.

It is another object of this invention to provide a childproof latch for the reclosable lid of a container, which latch requires finger dexterity unavailable to a child.

SUMMARY

The present invention is summarized in that a container with a reclosable lid includes a lower frame secured to the top of the container with an upper frame being hinged to the lower frame to open and close the container and a childproof latch having a keeper fixed to the lower frame and a latching device fixed to the upper frame. The latching device has a projection extending from the upper frame provided with finger grips extending in opposite directions from the projection and a retainer on one finger grip disposed to prevent movement of the keeper whereby the upper and lower frames are locked in a closed position on the container top. The childproof latch is operated by flexing the two finger grips toward the rear portions of the two frames and thence upwardly to displace the retainer past the keeper.

DETAILED DESCRIPTION

Figure 1:
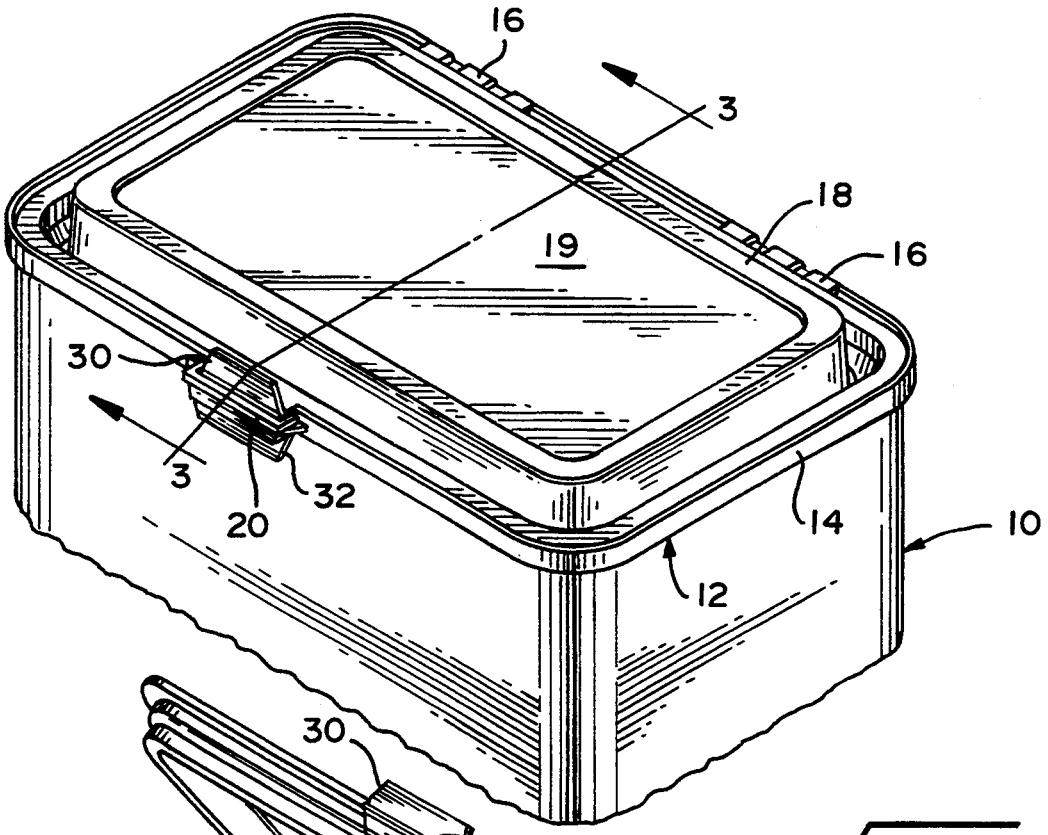
FIG. 1 is a partial perspective view of the top portion of a container embodying the present invention.
Figure 2:
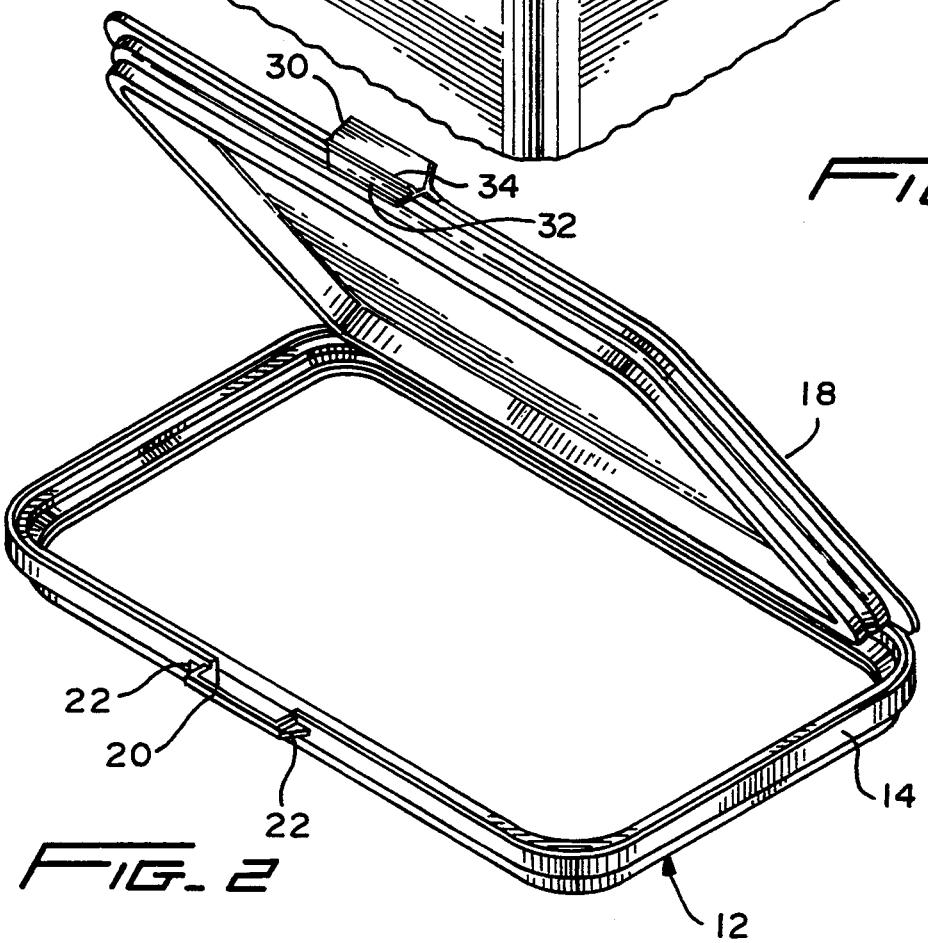
FIG. 2 is a perspective view of the lid shown in FIG. 1.

As is illustrated in FIG. 1, a hollow container 10 having a generally rectangular configuration, other configurations may be utilized as desired or required for various goods and for aesthetic purposes. The container 10 may be made of metal, cardboard or plastic or any other suitable material including combinations of metal, cardboard and plastic.

Figure 3:
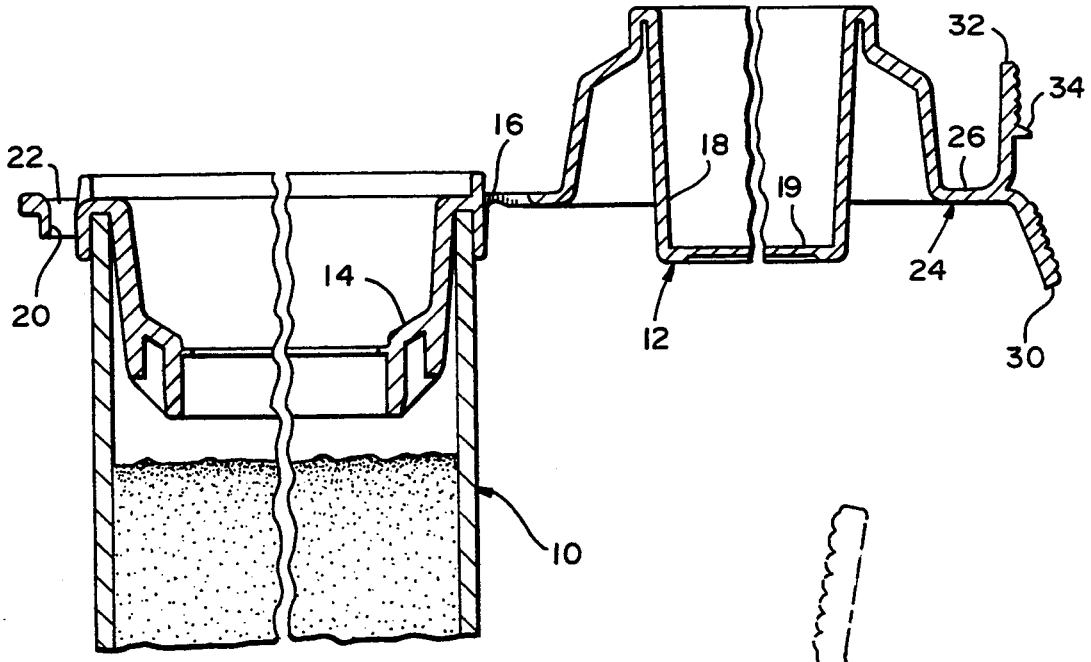
FIG. 3 is an enlarged cross sectional view taken along the L-shaped line 3—3 in FIG. 1 but showing the lid in a fully opened position.

Only the upper portion of the container 10 is shown in FIG. 1 and 3 so it is to be understood that a lower portion is included such as is shown in FIG. 1 of U.S. Pat. No. 4,736,870. FIG. 3 also shows the particular product as being a powder substance such as an automatic dishwashing detergent.

A lid 12 for the container 10 includes a lower frame 14 adapted to be secured to the container in any suitable manner from U.S. Pat. No. 4,736,870 and No. 5,050,763. The frame 14 is shown as a rectangle, but other suitable shapes may be used. The frame 14 is a rectangle defined by its four edges while the space therebetween opens into the top of the container 10. A series of spaced hinges 16 along its rear edge (FIG. 1) connects the lower frame 14 to a mating upper frame 18 which is also rectangular but with a lid plane 19 extending between the four edges of the rectangle. Centrally located along its front edge, the lower frame 14 supports a keeper bar 20 provided with end projections 22—22 for integral attachment to the front edge.

Figure 4:
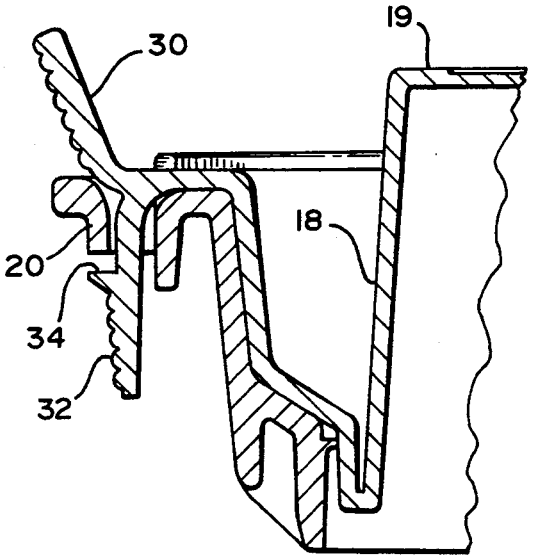
FIG. 4 is a partial cross sectional view of the left side of FIG. 3 but on a larger scale and in a closed position.
Figure 5:
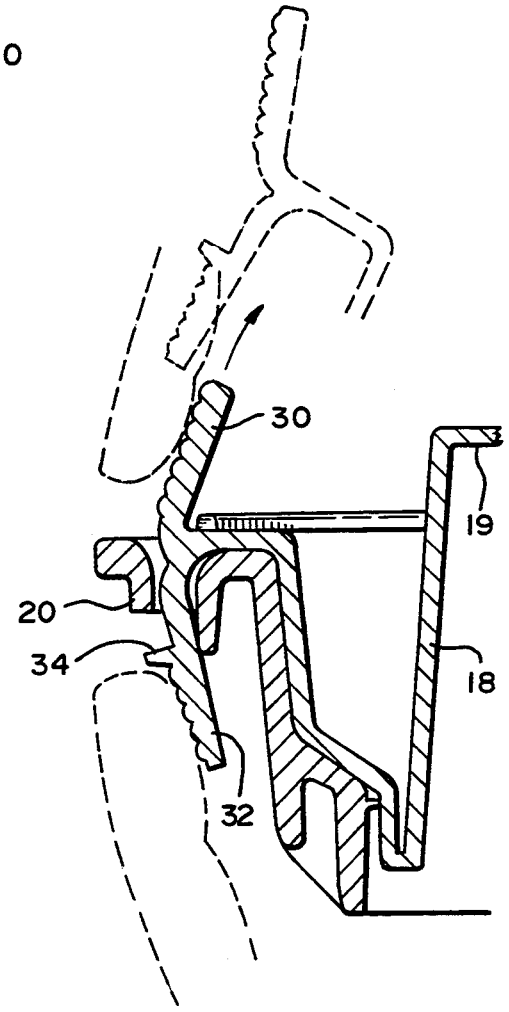
FIG. 5 is a cross sectional view similar to FIG. 4 with dashed line portions added to show the operation of the lid.

Centrally positioned along its front edge, the upper frame 18 carries a latch 24 in alignment with the keeper bar 20 for cooperation therewith. The latch 24 includes an attachment projection 26 extending from the front peripheral edge of the upper frame 18 (see FIG. 3). In a general T-shape arrangement, the latch 24 also includes top and bottom finger grips 30 and 32 extending f r ore the projection 26. As shown in FIGS. 3, 4 and 5, a retainer block 34 is disposed on the bottom finger grip 32 across the entire width thereof so as to be adjacent the keeper bar 20 and thus obstruct movement of the upper frame 18. The front surfaces of the finger grips 30 and 32 are serrated to facilitate finger operation.

In constructing the present invention, a plastic material is utilized for the lid 12 which is molded as a unit by any suitable molding processes such as injection molding or the like. The lower frame 14 of the lid 12 is secured to the upper perimeter edge of the container 10 by any suitable means such as sealing wax or glue. The product may be inserted into the container 10 before or after the lid 12 is secured to the container. With the upper frame being hinged to the lower frame, the upper frame may be pivoted about the hinge axis to open the container or to reclose the container.

Inasmuch as the present invention is subject to many modifications, variations and changes in detail, it is intended that all matter contained in the foregoing description or shown on the accompanying drawings shall be interpreted as illustrative and not in a limiting sense.

I claim:

1. A container comprising a reclosable lid having a lower frame secured to a top of the container and an upper frame mating with said lower frame to close the container, hinge means connecting rear portions of said upper and lower frames for relative movement therbetween, a childproof latch having a keeper means for engaging a latching means fixed to a front portion of said lower frame, and said latching means fixed to a front portion of said upper frame, said latching means including a projection extending from a front edge of said upper frame and having top and bottom finger grips extending in opposite directions from said projection, and a retainer block on said bottom finger grip placed to interfere with movement of said keeper means whereby said upper and lower frames are locked in a closed position on said container top, said latch being operable by flexing the top and bottom finger grips in a direction generally toward the rear portions of said upper and lower frames and thence upwardly to displace said retainer block past said keeper means.

2. A container as claimed in claim 1 wherein said keeper means includes a bar element engageable with said retainer block.

3. A container as claimed in claim 1 wherein said keeper means comprises a keeper bar having end portions extending away from the front portion of said lower frame whereby the keeper bar is spaced from the lower frame.

4. A container as claimed in claim 3 wherein said projection on said upper frame spaces said upper finger grip away from said lower finger grip so as to define a movable path similar to said lower finger grip during opening and reclosing of said lid.

5. A container as claimed in claim 4 wherein said projection and said upper and lower finger grips are integrally formed to define a general T shape configuration.

6. A container as claimed in claim 1 wherein said container and said lid are rectangular in shape and wherein said hinge means are on one rectangular side and said child-proof latch is located on an opposite rectangular side.

7. A container as claimed in claim 1 wherein said reclosable lid, said hinge means, and said childproof latch are molded as an integral unit.

8. A container as claimed in claim 1 wherein said upper and lower frames, said hinge means, said keeper means, and said latching means are molded as an integral unit.

* * * * *